US005082507A

United States Patent [19]

Curry

[11] Patent Number: 5,082,507

[45] Date of Patent: Jan. 21, 1992

[54] AUSTEMPERED DUCTILE IRON GEAR AND METHOD OF MAKING IT

[76] Inventor: Gregory T. Curry, 1283 Oakwood Ct., Rochester Hills, Mich. 48307

[21] Appl. No.: 603,558

[22] Filed: Oct. 26, 1990

[51] Int. Cl.[5] ..... C21D 5/00

[52] U.S. Cl. ..... 148/2; 148/12 R; 148/321; 148/141

[58] Field of Search ..... 148/2, 12 R, 138, 139, 148/140, 141, 321

[56] References Cited

U.S. PATENT DOCUMENTS 4,222,793 9/1980 Grindahl ..... 148/321

4,541,878 9/1985 Mühlberger et al. ..... 148/139

FOREIGN PATENT DOCUMENTS 0174087 3/1986 European Pat. Off. .

*Primary Examiner*—R. Dean

*Assistant Examiner*—Sikyin Ip

*Attorney, Agent, or Firm*—Krass & Young

[57] ABSTRACT

An austempered ductile iron differential gear and method of manufacture. The gear is cast to near net shape in a vertical injection, flaskless moulding machine using delayed inmould inoculation to ensure greater homogeneity of the alloy melt. The gear casting is allowed to cool, then austenized at a temperature of 1628° F. for a period of approximately 1½ hours, and subsequently austempered in a quench bed at a temperature of approximately 526° F. for a period of approximately four hours.

16 Claims, 3 Drawing Sheets

FT-LBS

AUSTEMPERED DUCTILE IRON GEAR AND METHOD OF MAKING IT

BACKGROUND OF THE INVENTION

1. Field of the Invention

The present invention relates to differential gears cast from ductile iron, and more particularly to such a gear cast to near net shape in a flaskless moulding machine from iron inoculated in the mould with various alloying components, heat treated, and austempered, said differential gears having a microstructure predominantly acicular ferrite and high-carbon stable austenite, and characterized by high tensile strength, yield strength and hardness.

2. Description of the Relevant Prior Art

Differential gears are used in both rear wheel drive vehicles and four wheel drive vehicles, and permit the wheels of the vehicle to rotate at different rates while the vehicle is turning. Differential gears do not mesh 100% of the time, but engage only when the vehicle is turning. Because it does not engage all of the time, a differential gear does not have to operate as quietly as a constantly meshing gear. Hence, differential gears, typically made from carburized steel, may be used in an as-forged condition, and do not require additional machining after forging. They do, however, have to be able to withstand very low temperatures and high stress because of load fluxuation encountered by the vehicle, for example, going up or down a hill with a heavy load.

However, forged steel gears are expensive. First, a suitably sized stock piece must be formed of steel. Then, the steel is heated to its forging temperature, then forced into a die. Not only is the steel stock from which the gears are made relatively expensive, but the forging process itself is expensive, uses large amounts of energy, and is slow.

Austempered ductile iron is an alloyed and heat treated ductile cast iron. By varying the composition of the melt, and the heat treating and tempering parameters, austempered ductile iron can display a range of diverse mechanical properties. Characteristically, austempered ductile iron exhibits good yield strength, good impact strength, good tensile strength, high hardness, and outstanding wear resistance. Examples of various austempered ductile iron materials are disclosed in U.S. Pat. Nos. 3,549,430; 3,549,431; 3,860,457; 4,222,793; 4,541,878; 4,737,199; and 4,880,477. However, with conventional casting techniques, intricate castings for differential gears are often defective due to cracks and fractures, etc. because the alloys are inhomogeneous, and contain oxidized alloying elements. Thus, undesirably high local concentrations of some alloying elements and oxides may be present in the casting which create weaknesses. When the intricate castings are subjected to austempering, which involves a quench operation, they are prone to fracture at these weak points. Hence, up until now, austempered, ductile iron has not been widely employed for differential gears and other intricate castings requiring qualities of good strength and wear resistance despite the fact it is otherwise well suited for this purpose.

It is known to employ austempered ductile iron in fabricating gears, but the gears are not cast from the material. For example, Vourinen et al. U.S. Pat. No. 3,860,457 discloses a ductile iron useful as a raw material for fabricating gears. A blank of ductile iron of a particular composition is austenized at a temperature of 900° C. for 2 hours, then quenched in a salt bath at a temperature of 370° C. for a period of time ranging from 10 minutes to 4 hours. This results in an isothermally bainitized blank which is then hardened by work hardening or by machining. Thus, a gear may be machined from such a blank. In U.S. Pat. No. 4,222,793, nodular iron gears are made by casting a nodular iron blank, annealing the blank, ferritizing its microstructure, machining teeth into the blank, austenizing the machined gear, quenching, and shot-peening the surface of the gear. The result is a gear having a surface with high residual compressive strength.

Such austempered ductile iron gears as those disclosed in the two patents referenced in the preceding paragraph are an alternative to conventional carburized, forged steel gears. However, the teeth of these prior art austenized ductile iron gears must be machined from the cast, heat treated metal. Obviously, such a machining step is expensive and difficult. Clearly, it would be advantageous to employ a method whereby differential gears could be cast from nodular iron to near net shape and subsequently austempered, with a minimum of machining.

SUMMARY OF THE INVENTION

Disclosed and claimed herein is an austempered ductile iron differential gear having a matrix composed principally of a acicular ferrite and high-carbon stable austenite and characterized in that it exhibits a yield strength of at least 190,000 psi, a tensile strength of at least 230,000 psi, a yield strength at −110° F. of at least 20 ft-lbs, an elongation of 2%, and a hardness of 410 BHN. The gear is cast from a nodular iron alloy melt consisting essentially of, by weight, 3–4% carbon, 1.5–3% silicon,0.1–5% manganese, up to 0.8% copper, up to 0.045 phosphorus, up to 0.01 sulfur and the balance iron, with negligible impurities, by a delayed, in-mould inoculation process. The gear, which has a plurality of teeth formed thereon, preferably is cast from said melt in a flaskless moulding machine using moulds created by urethane tooling to produce a ductile iron gear casting. The casting is allowed to cool, and then heat treated at a first temperature of between 1550°−1750° F. for a period of between 1–3 hours to effect austenization. The austenized casting is then quenched at a second temperature of between 460°–750° F. for a period of between 0.5 to 5 hours. Preferably, the austempering step is carried out at a temperature at the lower end of this range, such as approximately 526° F. It has been found that the high quench rates caused by a low austempering temperature results in an austempered ductile iron having good yield and tensile strengths, good wear resistance, and good elongation, all desirable characteristics in a differential gear. See, Kovacs, Belay, "Austempered Ductile Iron: Fact and Fiction," *Modern Casting*, volume 80, No. 3 (March, 1990) for a more complete discussion of the effects of quench rates on the mechanical properties of the resultant metal.

Typically, the gear further includes a plurality of bosses formed on the gear opposite the teeth. The teeth and bosses are cast such that, if any machining must be performed, it can be done solely on the bosses. Thus, in a typical flaskless moulding machine, which provides for continuous casting of a plurality of parts, one or more moulds are provided, each of which consists of two halves called match plate patterns. Preferably the teeth should be cast in one half and the bosses in the other. The gear of the present invention can also be cast in a horizontal cope and drag mould. Preferably, the teeth of the gears are cast in the drag, and the bosses are casted in the cope. Before the gear casting has been austenized, the bore of the gear is machined, and any additional necessary machining is performed on the bosses, rather than on the teeth of the gear, thus greatly simplifying the machining step. Preferably, the gear is cast to near net shape, such as by use of urethane tooling, so that any machining steps are kept to a minimum. To this end, the mould parts are appropriately configured and sized to allow for shrinkage during the cooling process.

Thus, the differential gear and method of manufacture contemplated by the present invention represents a great savings in cost and improved performance characteristics over the prior art. In contrast to prior art carburized, forged differential gears, the present gear is cast from a relatively inexpensive stock material. No expensive, slow and equipment-intensive forging step is required. A forging step is a very wear intensive process on the equipment. In contrast to prior art methods for making austempered ductile iron gears, the gear is cast to near net shape and machining is kept to a minimum. Furthermore, the method of the present invention results in a differential gear having good performance characteristics, such as high yield strength, high tensile strength, good low temperature impact strength, moderate ductility, and high abrasion resistance. In fact, the austempered ductile iron gear of the present invention is superior in some performance characteristics to a carburized steel gear in that it is lighter, has better low temperature impact strength, absorbs more noise due to the damping effect of the nodular carbide, and is somewhat porous so as to hold lubricants, thus maintaining the gear's lubrication.

BRIEF DESCRIPTION OF THE DRAWINGS

The following detailed description may best be understood by reference to the following figures in which.

DETAILED DESCRIPTION OF THE PREFERRED EMBODIMENTS

This invention contemplates an austempered ductile iron differential gear and method of making such gears. The gear has a matrix comprising principally acicular ferrite and high-carbon stable austenite, with portions of retained austenite. The microstructure of the austempered ductile iron of the present invention may be seen in FIG. 3 which shows a specimen of such material etched and enlarged one thousand times. The dark areas are graphite modules, and light areas may be seen at the cell boundaries of the acicular ferrite high-carbon stable austenite which are areas of retained austenite. The material shown in FIG. 3 has a yield strength of upward of 125,000 psi, a tensile strength of upward of 175,000 psi an impact strength at −110° F. of at last 20 ft-lbs, and a hardness of upward of 340 BHN. It exhibits some elongation, typically at least about 2%.

The gear of the present invention is cast from an alloy melt consisting essentially of, by weight, 3–4% carbon, 1.5–3% silicon, 0.1–0.5% manganese, up to 0.8% copper (or nickel or combinations thereof), up to 0.4% phosphorus, up to 0.1% sulfur, and the balance iron and accidental impurities. Preferably, the alloy melt has a composition consisting essentially of 3.8% carbon, 2.03% silicon, 0.27% manganese, up to 0.58% copper, 0.025% phosphorus, 0.007% sulfur, and the balance iron and accidental impurities.

It is critical to the present invention that the differential gears be cast from an alloy melt of the above composition produced by a delay, inmould inoculation process. That is, the alloying materials are introduced into the mix immediately before casting, thus ensuring greater homogeneity of the alloy mix. If alloying components, as is typical, are introduced into the alloy mix while still in the ladle, irregularities and homogeneity of the alloy mix tend to occur, resulting in weak castings. The various alloying components are temperature sensitive, and may oxidize out of the alloy mix, or rise in the mix to form part of the slag. By introducing the alloying components in the mould at the last possible moment, these problems are greatly minimized, resulting in a much more homogeneous mix. This permits intricate castings, such as the differential gear of the present invention, to be successfully cast free of any defects likely to result in failure during operation. Thus, by utilizing delayed inmould inoculation casting techniques, it becomes feasible to cast an intricate casting like a differential gear.

Figure 1:
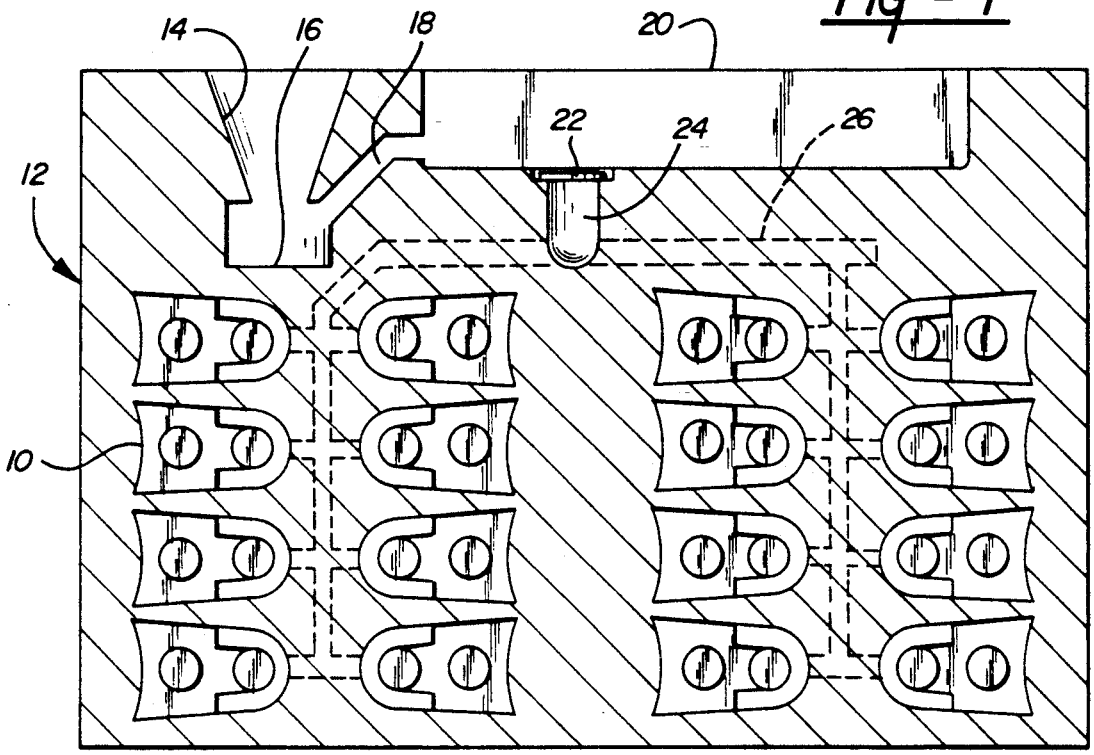
FIG. 1 is an inside plan view of one half of a mould suitable for use in the method of the present invention.

FIG. 1 is an inside plan view of a mould plate useful for practicing the method of the present invention. The mould plate 12 of FIG. 1 is designed to be used in a vertical injection, flaskless, continuous moulding machine operation. Preferably, the actual mould plates which are composed of sand and various binders, are produced by urethane tooling. According to this technology, a mould master is created which conforms to the net shape of the item to be cast, taking shrinkage due to cooling into account. The mould master is used to cast a plurality of urethane toolings, which are in turn used to mould the urethane tooling, it is possible to rapidly and inexpensively cast a large number of metal castings to near net shape. The urethane castings are relatively inexpensive to make. Thus, in contrast to conventional metal toolings, they may be discarded and replaced before they become abraided by the sand used to make the actual moulds. In contrast, metal toolings cannot be readily and inexpensively replaced when they become abraided, thus resulting in castints of less than near net shape. The mould plate 12 shown in FIG. is, preferably, made from urethane tooling, and is designed to produce a plurality of gear castings 10.

Formed in mould plate 12 is an inlet 14 through which a measured amount of molten iron is poured. The molten metal (not shown) enters an inoculation area 16 formed at the base of inlet 14 which contains correctly measured amounts of the alloy additives. To create nodular cast iron, pig iron is used containing flakes of graphite. A modulizing agent such as magnesium or serium is added to the molten pig iron and causes the graphite flakes therein to form round nodules, thus improving the strength characteristics of the metal. Generally, most of the nodularizing material oxidizes in the molten iron, and most of the rest is recoverable in the slag. Thus, little is actually present in the casting.

After the molten iron has been inoculated with the alloying components in inoculation area 16, it passes through feeder 18 into reservoir 20 and remains there for a short "stay period" to allow various impurities and slag products to rise to the surface, thereby preventing them from following the cast metal down into the mould cavity. The length of this stay period is regulated by a melting disk 22 which blocks reservoir outlet chute 24. After a certain time, the molten metal in reservoir melts the melting disk 22 and flows through chute 24 and conduits 26 into the mould cavity to form gears 10. The mould is then allowed to cool.

In a typical production setting, a plurality of mould plates 12 (and their matching counterpart plates) are employed so that continuous casting is possible. A method of continuous casting by stepwise advancement of identical, flaskless mould parts is disclosed, for example, in U.S. Pat. No. 4,549,600. Since these techniques are known in the art, they will not be discussed in detail. Typically, continuous casting in flaskless moulding machines is highly automated, and regulated by electronic process control. Thus, highly uniform, high quality castings may be relatively quickly produced.

After the casting has cooled for a period (typically approximately 45 minutes), it is then subjected to heat treatment and austempering. If the article being cast by the method of the present invention requires high tolerances, such as the bore of a gear, an additional machining step may be required. Since the method of the present invention may be practiced using horizontal moulds having copes and drags, it is highly desirable that the area of the cast part having the highest tolerances (such as the teeth of a differential gear) be cast in the drag side of the mould and the less critical areas be cast in the cope side. If this procedure is followed, the machining step will be performed on the areas of lower tolerance (such as the boss side of the differential gears), thus simplifying and shortening the machining step. However, since it is preferable that the gears of the present invention be cast to near net shape, it is contemplated that the machining step may be minimized by employing vertical flaskless mould machines in the casting process, with the teeth of the gear being cast in one side of the mould and the bosses in the other, which arrangement is most likely to result in a part cast to near net shape.

After casting, the cast part is heated to an austenization temperature in the range of 1550°-1750° F. (preferably approximately 1628° F.) for a period of 1-3 hours (preferably 1.5 hours), in an atmosphere containing 1.10% carbon. During this stage of the treatment, the microstructure of the article is transformed into austenite. After austenization, the article is quenched in a salt bath and austempered at a temperature in the range of 460°-750° F. (preferably 526° F.) for a period of between 0.5 to 5 hours (preferably 4 hours).

Figure 2:
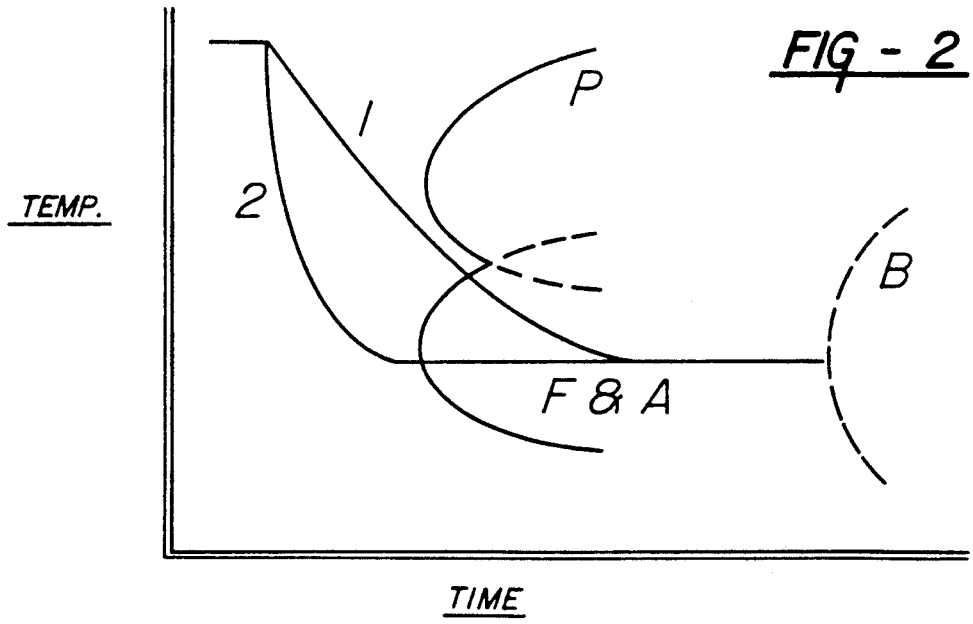
FIG. 2 is a time-temperature-transformation diagram which shows the effect of various quench temperatures on the austempering reaction.

FIG. 2 (adapted from Kovacs, supra.) illustrates the importance of the quench temperature on the resultant microstructure. The austempering "nose" (the time and temperature ranges at which the desirable ferrite and austenite structure will be formed) is that portion of the diagram labeled F and A. If the quench temperature is too high, the metal will pass through the portion of the diagram labeled P and a microstructure predominantly of perlite will be the result. If the article is quenched for too long a time, it will reach the area of the diagram labeled B and undesirable bainite will be the result.

Figure 3:
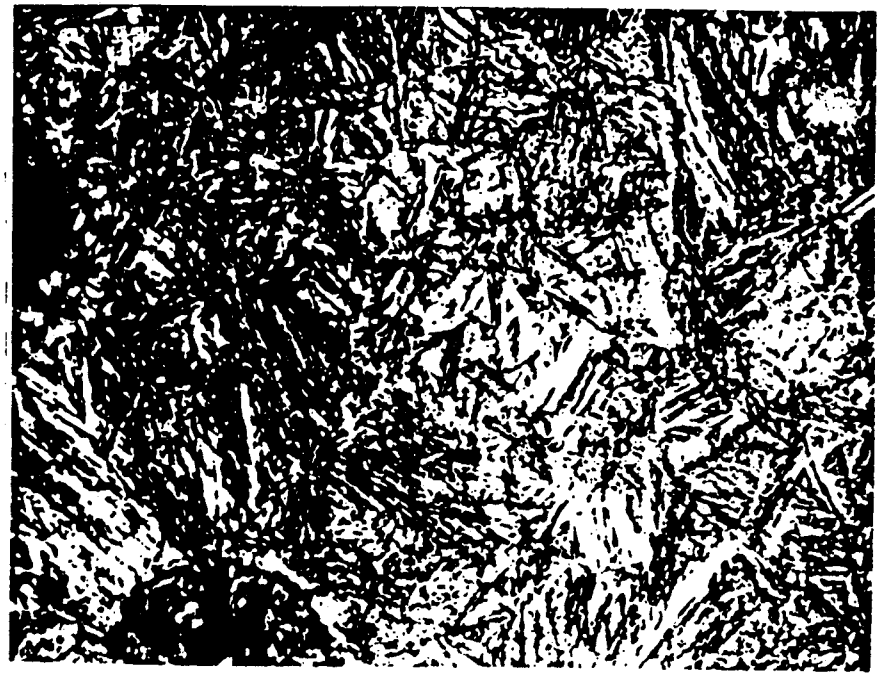
FIG. 3 is a photomicrograph of a sample of austempered ductile iron fabricated according to the method of the present invention (1000 x, etched)

If cooling curve 1 of FIG. 3 is followed, perlite formation will be avoided, but the cooling curve crosses the austempering nose at a higher temperature than desired. By the time the casting cools to the desired temperature, a significant volume of the casting has been reacted at higher temperatures and it will have a mixed microstructure. In contrast, when cooling curve 2 is followed, the austempered ductile iron structure will form at the desired temperature. High austempering temperatures typically result in high ductility, high fatigue and impact strengths and relatively low yield and tensile strengths. Low austempering temperatures result in austempered ductile iron having high yield and tensile strengths, high wear resistance, and relatively lower ductility and impact strength. Thus, in manufacturing the differential gear of the present invention, it is desirable that a cooling curve close to cooling curve 2 be followed, keeping in mind that a differential gear should ideally have some elongation. It has been found that a quench bed temperature of approximately 526° F. will result in the desirable properties.

Of course, the present invention is not limited to the manufacture of differential gears. The method of the present invention may be advantageously employed to create austempered ductile iron articles of any type where the characteristics of high yield and tensile strength, high abrasion resistance, elongation, and relatively low ductility are desired. Furthermore, the method of the present invention may be advantageously employed to create articles of intricate structure which are normally forged, rather than cast, due to the problems discussed above. Such articles include, by way of illustration and not limitation, gears in general, cam shafts, crankshafts, cams, clutch plates, forming dies, wear plates, etc.

Example 1

An alloy melt was prepared and cast in a Disamatic® vertical injection flaskless moulding machine employing a delayed, inmould injection technique. The alloy melt was a D-4512 (SAE number) base iron having the following typical chemistry, expressed in weight: 3.80% carbon, 2.03% silicon, 0.27% manganese, 0.08% copper, 0.025% phosphorus, 0.007% sulphur and the balance iron. The final composition of the iron, expressed in weight was: 3.0% carbon, 2.60% silicon, 0.2% manganese, 0.08% copper, 0.025% phosphorus, 0.007% sulphur and the balance iron.

The alloy melt was cast into test bars. After casting, the bars were austenized for a period of 1½ hours at a temperature of 1620° F. The austenized bars were then austempered in a salt bed for a period of 4 hours for a temperature of approximately 526° F.

The test bars were then tested for various mechanical characteristics. Test results indicated that yield strength ranged between 194,280-195,720 psi, tensile strength ranged between 235,620-238,360 psi, hardness (Brinell) was 418 BHN, and elongation ranged between 2.0 (Brinell 2.3%.

Figure 4:
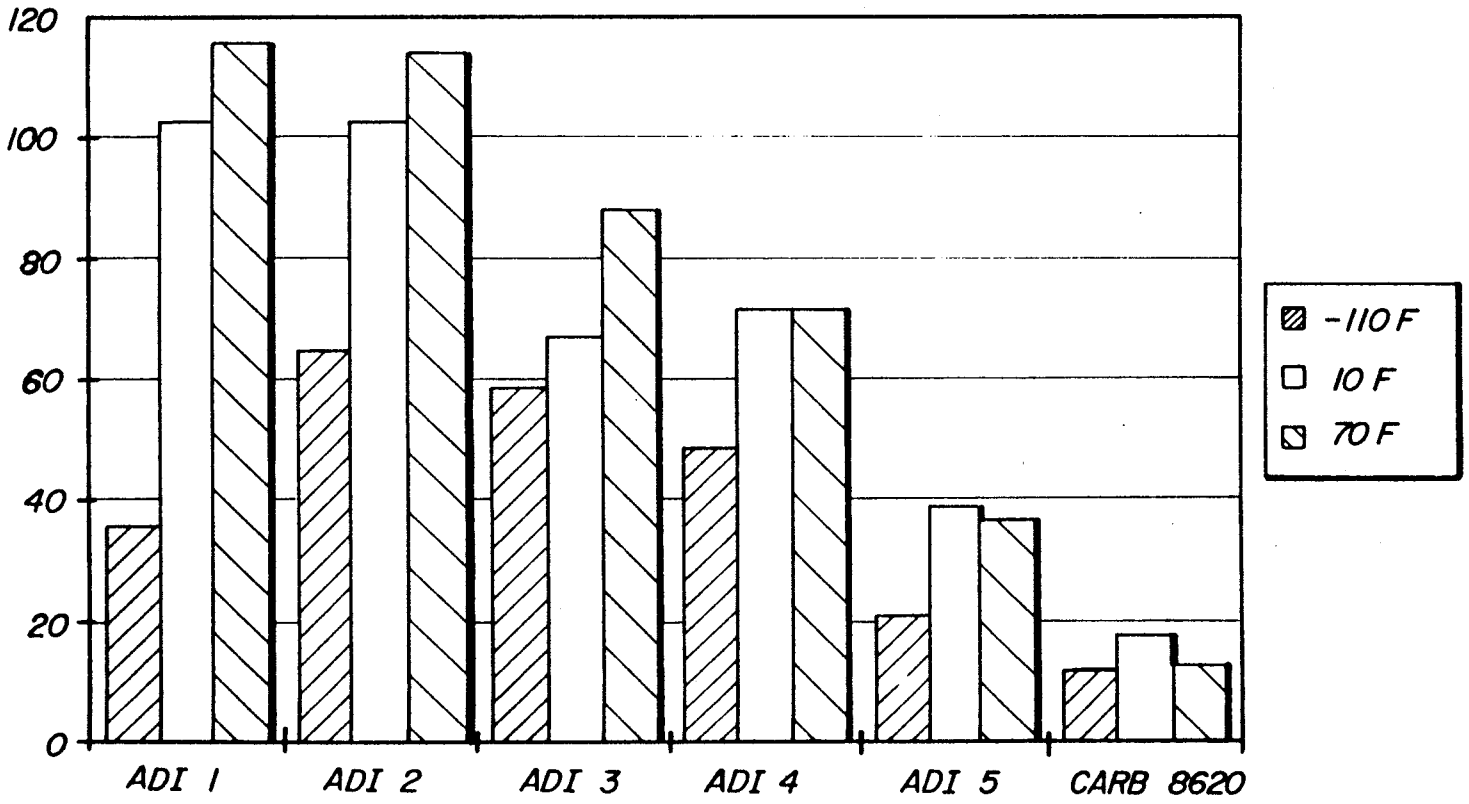
FIG. 4 is an impact strength versus temperature graph for various materials.

Austempered ductile irons are classified into five grades per ASTM A897 M-9 standards according to their mechanical property requirements. Generally, grade 1 austempered ductile iron has the least stringent requirements for tensile strength, yield strength and hardness, and has higher values for elongation and impact energy, with grade 5 having the highest values for tensile strength, and hardness and lower values for elongation and impact energy. Furthermore, as can be seen in FIG. 4, the metal's temperature has a profound effect on performance characteristics. FIG. 4 shows that impact strength stays relatively constant as temperature is decreased to 10° F., but falls markedly when the temperature drops to −110° F. The requirements for a grade 5 austempered ductile iron are a minimum tensile strength of 230 ksi, minimum yield strength of 185 ksi, a Brinell hardness number of at least 444, and unspecified elongation and impact energy, although the requirements for grade 4 for these characteristics are, respectively, 1 inch, minimum percent, and 25 foot-lbs. On this basis, the test bars were adjudged to be grade 4 or grade 5 austempered ductile iron.

If the material of the present invention is to be used to make a differential gear, a balance of characteristics is desirable. In particular, the gear should have moderate elongation and good impact strength at lower temperatures, since a differential gear must operate over a range of temperatures and under varying loads. It is desirable that the differential gear of the present invention comprise austempered ductile iron of grades 3–5. According to FIG. 4, gears of such materials will exhibit superior impact values, even at low temperatures, over conventional carburized steel gears.

It is anticipated that the base iron could advantageously be a number of grade irons, such as D-5506 grade iron. Typical chemistries of this iron are similar of D-4512 iron, except that the weigh percentage of copper is higher, typically about 0.58%. The expected effect of using D-5506 iron in making the casting is that the final product will exhibit a higher hardness, typically in the range of 408–490 BHN. This would conform to a grade 5 austempered ductile iron.

The above invention has been described with regard to certain exemplifications and embodiments thereof. Doubtless, variations in the techniques described may occur to one skilled in the art without departing from the spirit of the inventive concept claimed herein. For example, alloy melts of different compositions from those described above may be used, and the steps of austenizing and austempering may be carried out at somewhat different process parameters. Also, for certain applications, additional processing steps may be required to endow the finished article with certain desirable properties. Furthermore, a wide variety of articles other than differential gears may be cast by the method of the present invention. It is the following claims and equivalents thereof rather than the embodiments described in the specification which define the true scope of the present invention.

I claim:

1. A method for forming a differential gear comprising the steps of:

forming a substantially homogeneous nodular iron alloy melt consisting essentially of, by weight, 3–4% carbon, 1.5–3% silicon, 0.1–0.5% manganese, up to 0.8% copper, up to 0.04% phosphorus, up to 0.015 sulfur, and the balance iron by a delayed, inmould inoculation process to insure homogeneity of the melt;

casting a gear having a plurality of teeth thereon from said melt in a flaskless moulding machine to produce a ductile iron gear casting of substantially homogeneous composition;

allowing said casting to cool;

heat treating said cooled casting at a first temperature of 1550°–1750° F. for a period of between 1 to 3 hours; and quenching said heat treated casting to a second temperature of 460°–750° F. for a period of 0.5 to 5 hours to produce an iron having a matrix of acicular ferrite and high-carbon stable austenite.

2. The method of claim 1 wherein the gear further includes a plurality of bosses formed on the gear opposite the teeth, and the method includes the further step of machining the bosses prior to the heat treatment step.

3. The method of claim 1 wherein the method comprises the further step of casting the gear in a vertical injection, flaskless moulding machine.

4. The method of claim 1 comprising the further step of providing the moulding machine with at least one mould having a matching drag and a cope, and casting the teeth of the gear in said drag.

5. The method of claim 1 comprising the further step of casting the gear to near net shape.

6. The method of claim 5 comprising the further step of providing a urethane tooling and forming at least one mould from said tooling.

7. The method of claim 1 comprising the further step of heat treating the cast gear at a first temperature of approximately 1628° F.

8. The method of claim 1 comprising the further step of heat treating the casting for a period of approximately 1.5 hours.

9. The method of claim 1 comprising the further step of quenching the heat treated casting at a second temperature of approximately 526° F.

10. The method of claim 1 comprising the further step of quenching the heat treated casting for a period of approximately 4 hours.

11. A method for forming an austempered ductile iron article comprising the steps of:

forming a substantially homogeneous nodular iron alloy melt consisting essentially of, by weight, 3–4% carbon, 1.5–3% silicon, 0.1–0.5% manganese, up to 0.8% copper, up to 0.04% phosphorus, up to 0.01% sulfur, and the balance iron by a delayed inmould inoculation process to insure homogeneity of the melt;

casting an article from said melt in a vertical injection, flaskless moulding machine to produce a ductile iron casting of substantially homogeneous composition;

allowing said ductile iron casting to cool;

heat treating said ductile iron casting at a first temperature of approximately 1628° F. for a period of approximately 1.5 hours; and quenching said heat treated casting to a second temperature of 526° F. for a period of approximately 4 hours to produce an austempered ductile iron article having a matrix of acicular ferrite and high-carbon stable austenite, said article characterized in that it has a yield strength of at least 125,000 psi, a tensile strength of at least 175,000 psi, an impact strength at −110° F. of at least 20 ft-lbs, an elongation of at least 2%, and a hardness of 340 BHN.

12. The method of claim 11 further comprising the further step of casting the article to near net shape.

13. An austempered, ductile iron article formed from an iron alloy melt having a substantially homogeneous composition consisting essentially of, by weight, 3–4% carbon, 2–2.5% silicon, 0.25–0.3% manganese, 0.05–0.6% copper, 0.2–0.3% phosphorus, 0.005–0.01% sulfur, and the balance iron, and formed by a delayed inmould inoculation process to insure homogeneity of the melt, said article being cast in a flaskless moulding machine, cooled, heat treated at a first temperature of approximately 1628° F. for a period of approximately one ½ hour, and quenched at a second temperature of approximately 526° F. for a period of approximately 4 hours to produce an article having a matrix of acicular ferrite and high-carbon stable austenite, said article being characterized in that it exhibits a yield strength of at least 125,000 psi, a tensile strength of at least 175,000 psi, an impact strength of at least 20 ft-lbs at −110° F., an elongation of at least 2%, and a hardness of at least 340 BHN.

14. The article of claim 13 further characterized in that is cast to near net shape.

15. An austempered, ductile iron differential gear formed from a nodular iron alloy having a substantially homogeneous composition consisting essentially of, by weight 3–4% carbon, 2–2.5% silicon, 0.25–0.3% manganese, 0.05–0.6% copper, 0.2–0.3% phosphorus, 0.005–0.01% sulfur, and the balance iron and formed by an inmould inoculation process to insure homogeneity of the melt, said gear having a matrix of acicular ferrite and high-carbon stable austenite, and being characterized in that it exhibits a yield strength of at least 125,000 psi, a tensile strength of at least 175,000 psi, an impact strength at −110° F. of at least 20 ft-lbs, an elongation of at least 2%, and a hardness of at least 340 BHN.

16. The differential gear of claim 15 further characterized in that it is cast to near net shape.

* * * * *

UNITED STATES PATENT AND TRADEMARK OFFICE

CERTIFICATE OF CORRECTION

PATENT NO. : 5,082,507

DATED : January 21, 1992

INVENTOR(S) : Gregory T. Curry

It is certified that error appears in the above-identified patent and that said Letters Patent is hereby corrected as shown below:

Column 4, Line 55, Please delete "Fig. is" and insert -- Fig. 1 is --.

Column 6, Lines 60 and 61, Please delete "2.0 (Brinell) 2.3%" and insert -- 2.0 - 2.3% --.

Column 7, Line 61, Please delete ".015%" and insert -- .01% --.

On the title page:

Under References Cited, Please delete all references cited and insert the following references:

2,324,322 7/43 D.J. Reese et al 148/3
2,485,760 10/49 K.D. Millis et al 75/123
3,273,998 9/66 R.J. Knoth et al 75/123
3,549,431 12/70 De Castelet 148/141
3,549,430 12/70 F.K. Kies et al 148/35
3,860,457 1/75 Vourinen et al 148/15
3,893,873 7/75 Hanai et al 148/12
4,222,793 9/80 Grindahl 148/2
4,343,661 8/82 Rice 148/134
4,541, 878 9/85 Muhlberger 148/139
4,596,606 6/86 Kovacs et al 148/3
4,666,533 5/87 Kovacs et al 148/2
4,737,199 4/88 Kovacs et al 148/3

UNITED STATES PATENT AND TRADEMARK OFFICE

CERTIFICATE OF CORRECTION

PATENT NO. : 5,082,507

DATED : January 21, 1992

INVENTOR(S) : Gregory T. Curry

It is certified that error appears in the above-identified patent and that said Letters Patent is hereby corrected as shown below:

On the title page: Under References Cited: Deleted all references cited and insert the following references:

4,880,477 11/89 Hayes et al 148/141
4,549,600 10/85 Kauserud 164/323

Signed and Sealed this

Twenty-seventh Day of April, 1993

*Attest:*

MICHAEL K. KIRK

*Attesting Officer*

*Acting Commissioner of Patents and Trademarks*